United States Patent [19]

Bakewell et al.

[11] 4,377,881

[45] Mar. 29, 1983

[54] GAS-WIPE APPARATUS FOR AUTOMATICALLY PASSING LARGER JOINTS IN TANDEM WORKPIECES THERETHROUGH

[75] Inventors: Frank W. Bakewell, Apollo; Wayne L. Briney, North Irwin; Charles D. Stricker, Monroeville, all of Pa.

[73] Assignee: United States Steel Corporation, Pittsburgh, Pa.

[21] Appl. No.: 296,686

[22] Filed: Aug. 27, 1981

[51] Int. Cl.[3] ..... B08B 5/02

[52] U.S. Cl. ..... 15/306 A; 118/63; 118/DIG. 18

[58] Field of Search ..... 15/306 R, 306 A, 306 B, 15/308; 118/63, 125, DIG. 18; 427/348

[56] References Cited

U.S. PATENT DOCUMENTS

| | | | |
|---|---|---|---|
| 2,522,289 | 9/1950 | Lodge | 118/125 |
| 3,044,098 | 7/1962 | Stalson | 15/306 A X |
| 3,736,618 | 6/1973 | Ramsey | 15/306 A |
| 3,854,527 | 12/1974 | Maroschak | 15/306 A X |

*Primary Examiner*—Chris K. Moore

*Attorney, Agent, or Firm*—William F. Riesmeyer, III

[57] ABSTRACT

The subject invention provides an improvement in split gas-wipe apparatus, which, although not limited thereto, is normally used in coating or cleaning applications on wire, rod, or strand. The conventional apparatus has two segments hinged along an outer edge parallel to the passline of the wire or rod. The segments have mateable half-conical guides on their entry side which, when contacted by joints in the workpieces, cause rotation of one segment, the other normally being fixed, so that the joints have sufficient space to automatically pass through. The improvement of this invention involves providing pivoted mounting means replacing the hinged joint, the mounting providing an axis of rotation for one of the segments in a plane normal to the passline and substantially spaced therefrom. Advantageously, much larger joints may pass through the apparatus. Furthermore, better guiding is achieved since the guide of the rotated segment remains centered in a plane through the passline and center of the guide of the fixed segment. Thus, the workpieces do not become dislodged from the guides when the segment is rotated, as tends to happen in the conventional apparatus when the joints are more than several times larger than the workpiece cross section.

4 Claims, 4 Drawing Figures

GAS-WIPE APPARATUS FOR AUTOMATICALLY PASSING LARGER JOINTS IN TANDEM WORKPIECES THERETHROUGH

BACKGROUND OF THE INVENTION

This invention relates to gas-wipe apparatus, particularly split gas-wipes for automatically passing large joints or splices therethrough.

The better comply with environmental regulations it is desirable to use gas-wipes on wire or strand tempering lines to remove quenching oil instead of burning it off as in previous practice. For processing on the line, tandem wire or strand pieces are joined by interlocking loops formed in their adjacent ends. The loops are very large compared to the cross section of the wire or strand itself. Use of gas-wipes on the line requires that such loops pass through the wipe automatically in order not to delay production.

Split gas-wipes are available for passing knots or small splices in workpieces. These devices have two mateable segments forming an opening for passage of a workpiece longitudinally therethrough. A plurality of spaced orifices formed in the peripheral wall of the opening direct gas flow toward the workpiece surface. The segments have mateable half-conical guide funnels on their entry side. One segment is mounted in fixed position in a bracket, the other hinged to the first along an edge parallel to the workpiece passline. When a knot or split larger than the cross section of the opening contacts the guides, it causes the hinged segment to rotate outwardly providing a space for the knot or splice to pass through. Usually, the up segment is rotatable and may be counterweighted to assure its rotation back to closed position after passage of the knot or splice. Thus, passage of the knots or splices is accomplished automatically.

For larger joints, between about 5 to 30 times the size of the cross section of a single workpiece, the conventional split wipe is not satisfactory. Rotation of the hinged segment tends to move the attached guide section out of the passline direction. Larger joints therefore tend to jump out of the passline preventing closure of the segments to their original position. Additionally, joints composed of interlocked loops such as those used on the wire tempering lines would not have room to pass through the knife at all and may hang up on the equipment. Where a plurality of strands are processed in close side-by-side relation space limitations prevent locating the hinge far enough from the passline to accomodate the joints.

It is therefore a primary object of the invention to solve the above-mentioned problems with split gas-wipes to permit passage of larger joints automatically therethrough.

SUMMARY OF THE INVENTION

The conventional split gas-wipe has two mateable half-circumferential segments which together define an opening for passage of successive tandem workpieces therethrough. The workpieces travel longitudinally on a passline centrally through the opening. The segments have at least one orifice for directing gas flow toward the workpiece surface, desirably from the peripheral wall of the opening. Guide means on the entry side of each segment funnel the workpiece into the passline. The guide sections attached to each segment together form a substantially continuous surface parallel to the passline and extending therearound. The surface is generally uniformly spaced from the passline in each plane normal thereto, but tapers from an opening contiguous to, and substantially the same size as, the segment opening at one end, to a larger opening remote from the segments. One of the segments if fixed, the other pivotally connected to the first along an outer edge of each of them. The edge being parallel to the passline, permitting rotation of the segment in a plane normal to it. The rotatable segment is automatically returnable to its original position either by gravity or other return means.

According to this invention an improvement is provided in which a pivotal mounting means replaces the aforementioned hinged attachment of the two segments. The mounting provides an axis of rotation for one of the segments lying in a plane normal i.e. at a right angle to the workpiece passline but substantially spaced from the passline itself. The other segment remains fixed, thus together with the guide of the rotated segment providing continual guiding of the workpiece and joint as they pass through the apparatus. Desirably, where the joint is extremely large for example if formed of interlocked loops in the workpiece ends, the guide sections have diametrically opposed openings extending lontidudinally along the passline at 90° locations from the direction of rotation of the pivotally mounted segment. This permits passage of interlocked loops of large size where the loops are aligned at 90° with respect to each other, one in the plane through the center of the two guide sections, the other normal thereto. When the loop in the leading workpiece is aligned normal to the guide sections the slope angle of the guides must be shallow enough to cause early contact of the trailing loop with them opening up the segments for passage of the leading loop. Additionally, where a plurality of workpieces are processed in close side-by-side relation, a plurality of gas wipes may be used, each with a corresponding segment pivotally mounted on a common mounting means for consonant rotation of all of them when a joint passes through any, thus assuring passage of the joints unhindered by adjacent gas-wipe apparatus.

DESCRIPTION OF THE PREFERRED EMBODIMENT

Figure 1:
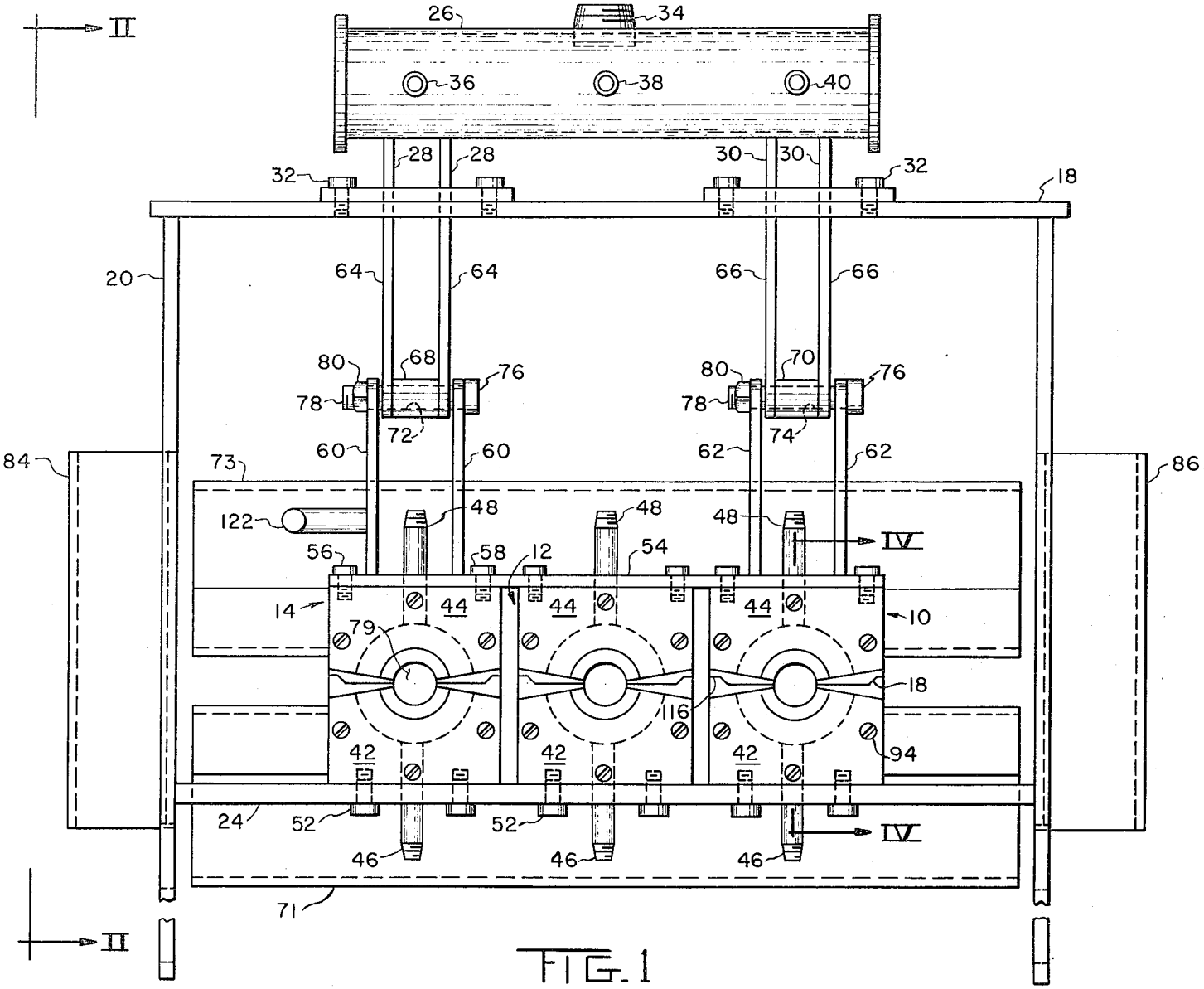
FIG. 1 is an elevation view of the apparatus of the present invention from the exit side thereof.

Referring to FIG. 1 split gas-wipes 10, 12, and 14 are mounted in frame 16 fabricated of plates 18, 20, 22, 24 welded to form a rectangular box opening. Manifold 26 is welded to spaced mounting bars 28, 30 secured to the frame by bolts 32. The manifold is a pipe enclosed at opposite ends with an inlet 34 for connection to a gas supply (not shown) and outlets 36, 38, 40 for each gas-wipe. Each outlet is connected to the gas wipes by suitable piping (not shown) to inlets 46, 48 on each segment. The lower segments 42 of each wipe are secured in fixed position on plate 24 of the frame by screwbolts 50, 52. Upper segments 44 of each wipe are similarly secured to mounting plate 54 by bolts 56, 58. Plate 54 is connected by pairs of spaced bars 60, 62 to fixed pair of arms 64, 66. Arms 64, 66 have sockets 68, 70 for receipt of pins 72, 74 each with head 76 and threaded end 78 secured by nuts 80 so as to readily connect bars 60, 62 pivotally in the mounting means.

Figure 2:
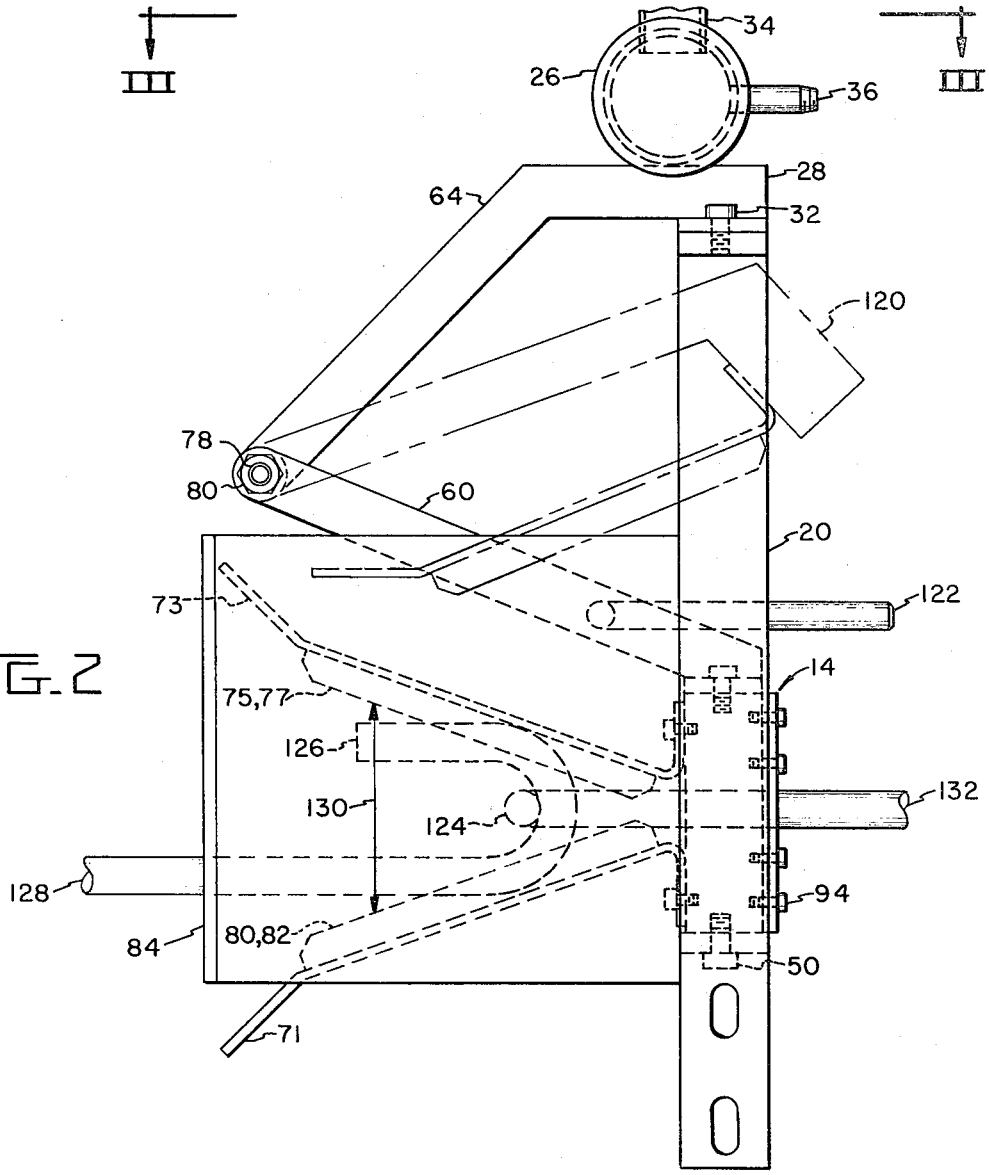
FIG. 2 is a side elevation view of the apparatus of FIG. 1 showing the various positions of the pivotally mountd gas-wipe segment.
Figure 3:
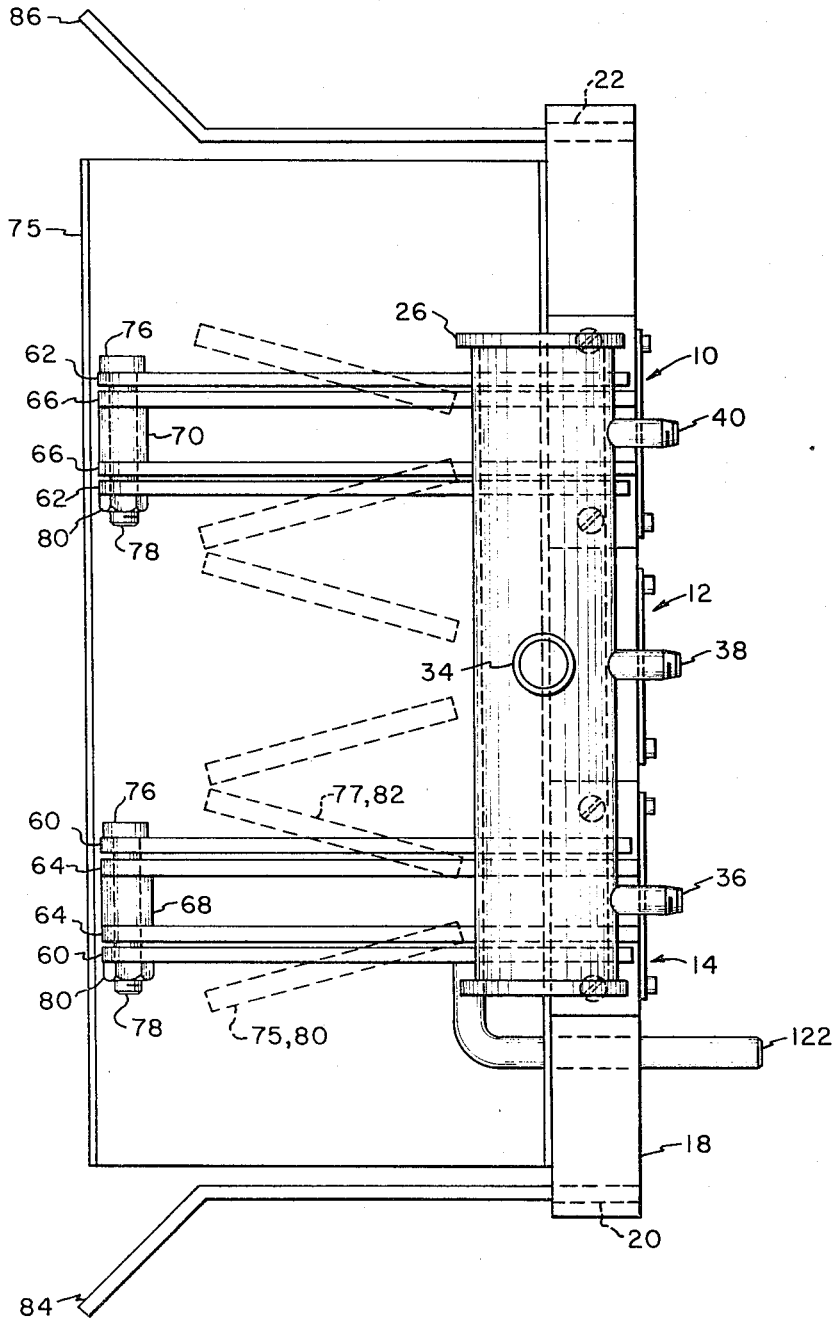
FIG. 3 is a plan view of the apparatus of FIG. 2.

Referring now to FIG. 2 in addition to FIG. 1, guide means is provided on the entry side of the gas-wipe segments and includes plates 71, 73 bolted respectively to the upper and lower segments. As is evident from FIG. 1 plates 71, 73 extend across the full width of the three segments which in the preferred embodiment shown provides consonant movement of all the upper segments in the pivotal mounting means as hereafter described. Plate 73 connected to upper segments 44 has a series of V-positioned guide bar pairs 75, 77 welded to it for funnelling workpieces (as more clearly indicated in FIG. 3) into the opening 79 (FIG. 1) of the segments. Plate 71 has similarly aligned guide bar pairs 80, 82 for performing the same function. Desirably side guides may also be provided for example, as shown at 84, 86 of FIGS. 1, 2 and 3 secured in fixed position to plates 20, 22 respectively of the frame.

Figure 4:
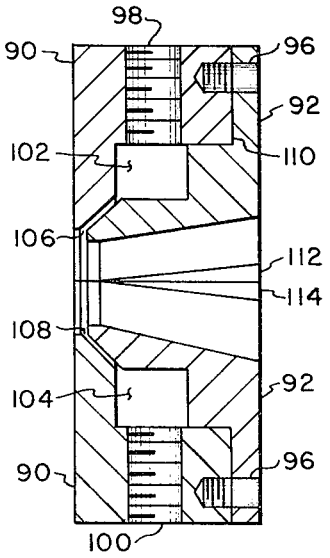
FIG. 4 is a section taken at IV—IV of FIG. 1.

Referring to FIG. 4 each upper and lower segment 42, 44 includes housing 90 and mateable insert 92 bolted together by screwbolts 94 (FIG. 1) in holes 96 (FIG. 4). Ports 98, 100 in the segments receive threaded inlet piping for supply of gas from the manifold. Semiannular spacings 102, 104 formed between the housing and insert direct gas to semiannular knife orifices by passages 106, 108. Shims (not shown) may be positioned between the face 110 of the housing and insert for varying the width of the orifice as desired. Desirably shoe plates 112, 114 mounted to the inserts are provided to seal the top and bottom faces of the lower and upper segments orifices. The shoe plates are preferably tongue and grooved in mateable offsets 116, 18 (FIG. 1) to assist in aligning segments after they have been opened to allow passage of a joint or splice in the workpiece therethrough.

In operation the workpieces are initially strung through the apparatus by rotating the upper segments to an open position as shown at 120 (FIG. 2). This may be accomplished manually by lifting lever arm 122 (FIG. 2). When a joint, such as interlocked loops 124, 126 (FIG. 2), arrives at the gas-wipe it contacts the guide plates and is funneled into the opening in the gas-wipe segments. Loop 126 in the trailing workpiece 128 is aligned in the plane through the center of V-positioned guide bar pairs in the upper and lower guide plates. Thus, it contacts the lower plate and rides up it simultaneously forcing upper guide plate and segment to pivot to an open position sufficient to permit passage of the joint. The opening 130 (FIG. 2) on each side of the gas-wipe between upper and lower guide bar pairs permits loop 124 in the leading workpiece 132 to pass unhindered toward the gas-wipe. As apparent from FIG. 2 the angle of inclination of the upper and lower guide plates is intentionally shallow enough with respect to the passline to cause rotation of the upper guide and segment by trailing loop 126 early enough to permit leading loop 124 to pass through between the segments.

It will be recognized that either the upper or lower segments may be pivotally mounted, or perhaps both may be so mounted. The guide means may be of any shape tending to funnel the workpieces into the opening of the segments. For example, mateable half-conical sections may be used for some applications. The angular relation and size of the guides may vary according to the size of joints anticipated will be contained in the workpieces. The pivotal guide and segments may be automatically returnable to original position by gravity under their own weight, or assisted by counterweights, or spring return. It may be desirable to delay the return somewhat by spring or shock absorber means in some applications. A plurality of gas-wipes may have separate guides separately or commonly mounted for either independent or consonant pivotal rotation as desired. And finally the gas-orifice in the wipe may be completely annular or spaced ports whichever prove best in any individual situation.

Other modifications of the device within the spirit and scope of the invention will be readily apparent to those skilled in the art and are intended to be covered by the following appended claims.

We claim:

1. In gas-wipe apparatus for removing at least excess liquid from the surface of elongated workpieces, said apparatus including two mateable half-circumferential segments defining an opening for passage of successive tandem workpieces longitudinally therethrough, said opening being adapted to receive the workpieces on a passline extending centrally therethrough, said segments having at least one orifice for directing gas flow toward the surface of the workpiece passing through the opening, said segments having guide means sections on an entry side thereof from which the workpieces are received, said guide means sections together forming a substantially continuous surface with an axis substantially coincident with the workpiece passline, said surface having an opening at one end contiguous to and of substantially the same size as the opening in said segments, said surface tapering outwardly from said passline in the direction from which said workpieces are received to a larger opening remote from said segments, one of said segments being pivotally connected to the other of said segments along an outer edge thereof parallel to said passline, the other of said segments being fixed in position, said one of the segments being rotatable about the axis of said pivotal connection when enlarged joints connecting adjacent ends of the workpieces contact the surface of said guide sections, said segment being returnable to the original position thereof after said joint has passed and thus automatically passing said joints through the apparatus, the improvement in said apparatus which comprises:

mounting means replacing the pivotal connection of said segments, said mounting means providing an axis of rotation for at least said one of the segments in a plane normal to said passline, spaced a sufficient distance from said passline, to permit joints of increased size to pass automatically through the apparatus without being dislodged from said passline.

2. The apparatus of claim 1 adapted to pass large joints of interlocked loops in adjacent workpiece ends, said loops lying in planes substantially normal to each other, the loop in the trailing one of said workpieces being aligned in the plane of rotation of said one of the segments, and wherein said guide means contain diametrically opposed openings extending longitudinally along said passline, for permitting passage of the loop in said leading workpieces unhindered therethrough, said guide means aligned at an angle with respect to the passline, shallow enough for contact with said trailing loop, to open said segment early enough for passage of the leading loop therethrough.

3. The apparatus of claim 2 further comprising another gas-wipe apparatus, mounted in side-by-side relation to the first mentioned said apparatus, said one of the segments of each apparatus being commonly mounted to said pivotal mounting means for consonant rotation of all of said segments mounted thereon about the axis thereof.

4. The apparatus of claim 2 wherein said segments have offset joints extending longitudinally parallel to said passline to assure proper alignment of said one of the segments when returned to the original seated position thereof.

* * * * *